US009238559B2

(12) United States Patent
Akai et al.

(10) Patent No.: US 9,238,559 B2
(45) Date of Patent: Jan. 19, 2016

(54) AUTO DOCUMENT FEEDER AND IMAGE FORMING APPARATUS

(71) Applicants: Takeshi Akai, Kanagawa (JP); Shinya Kitaoka, Kanagawa (JP); Koki Sakano, Kanagawa (JP); Fumiyuki Heishi, Kanagawa (JP)

(72) Inventors: Takeshi Akai, Kanagawa (JP); Shinya Kitaoka, Kanagawa (JP); Koki Sakano, Kanagawa (JP); Fumiyuki Heishi, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 60 days.

(21) Appl. No.: 14/185,965

(22) Filed: Feb. 21, 2014

(65) Prior Publication Data

US 2014/0239573 A1 Aug. 28, 2014

(30) Foreign Application Priority Data

Feb. 28, 2013 (JP) ..... 2013-038961

(51) Int. Cl.

| | |
|---|---|
| ***B65H 3/52*** | (2006.01) |
| ***B65H 3/06*** | (2006.01) |
| ***G03G 15/00*** | (2006.01) |
| ***B65H 1/14*** | (2006.01) |
| *G10K 11/16* | (2006.01) |

(52) U.S. Cl.

CPC .. *B65H 3/06* (2013.01); *B65H 1/14* (2013.01); *B65H 3/0684* (2013.01); *G03G 15/60* (2013.01); *B65H 2401/111* (2013.01); *B65H 2402/44* (2013.01); *B65H 2405/115* (2013.01); *B65H 2407/20* (2013.01); *B65H 2601/521* (2013.01); *B65H 2801/39* (2013.01); *G10K 11/16* (2013.01)

(58) Field of Classification Search

CPC ..... B65H 1/04; B65H 3/00; B65H 3/06; B65H 3/0684; B65H 3/46; B65H 2601/521; B65H 2401/111; B65H 2407/20; B65H 2405/115; G10K 11/16

USPC ..... 271/145, 167, 109, 121, 124, 18

See application file for complete search history.

(56) References Cited

U.S. PATENT DOCUMENTS

| | | | | |
|---|---|---|---|---|
| 4,606,535 | A * | 8/1986 | Larson | 271/10.03 |
| 5,970,866 | A * | 10/1999 | Okawa | 101/118 |
| 6,017,031 | A * | 1/2000 | Oosawa et al. | 271/121 |
| 7,942,410 | B2 * | 5/2011 | Wilsher et al. | 271/264 |
| 2004/0004319 | A1 | 1/2004 | Hattori et al. | |
| 2007/0264063 | A1 | 11/2007 | Sano et al. | |
| 2008/0308995 | A1 | 12/2008 | Tobinaga et al. | |
| 2010/0027081 | A1 | 2/2010 | Sano et al. | |
| 2010/0072692 | A1 | 3/2010 | Iida et al. | |
| 2010/0225045 | A1 | 9/2010 | Kimura et al. | |
| 2010/0225983 | A1 | 9/2010 | Fujii et al. | |

(Continued)

FOREIGN PATENT DOCUMENTS

| | | |
|---|---|---|
| JP | 2892286 | 2/1999 |
| JP | 11-334920 | 12/1999 |

(Continued)

*Primary Examiner* — Prasad Gokhale

(74) *Attorney, Agent, or Firm* — Harness, Dickey & Pierce, P.L.C.

(57) ABSTRACT

An auto document feeder includes a movable document table on which documents are stacked, a pickup roller that feeds a topmost document among the documents on the movable document table to a feed position via a feed opening, and a shielding member that is arranged on the upstream side of the pickup roller and above the topmost document, and that shields the feed opening. At least an end portion of the shielding member on the document table side is made of a flexible member.

15 Claims, 9 Drawing Sheets

(56) References Cited

U.S. PATENT DOCUMENTS

| | | | | |
|---|---|---|---|---|
| 2011/0074087 | A1* | 3/2011 | Akimatsu | 271/3.18 |
| 2011/0304092 | A1 | 12/2011 | Kambayashi et al. | |
| 2012/0002252 | A1 | 1/2012 | Kubo et al. | |
| 2012/0057212 | A1 | 3/2012 | Tobinaga et al. | |
| 2012/0119432 | A1 | 5/2012 | Kambayashi et al. | |
| 2012/0119436 | A1 | 5/2012 | Morita et al. | |
| 2012/0217696 | A1* | 8/2012 | Miwa | 271/117 |
| 2012/0217700 | A1* | 8/2012 | Miwa | 271/262 |
| 2012/0314267 | A1 | 12/2012 | Suzuki et al. | |
| 2013/0049291 | A1* | 2/2013 | Ohtsuki | 271/162 |
| 2013/0215481 | A1 | 8/2013 | Hayasaka et al. | |
| 2013/0242359 | A1 | 9/2013 | Heishi et al. | |
| 2013/0315610 | A1 | 11/2013 | Utagawa et al. | |
| 2014/0151953 | A1* | 6/2014 | Kozaki et al. | 271/121 |

FOREIGN PATENT DOCUMENTS

| | | |
|---|---|---|
| JP | 2003-002475 | 1/2003 |
| JP | 2006-193289 | 7/2006 |

* cited by examiner

AUTO DOCUMENT FEEDER AND IMAGE FORMING APPARATUS

CROSS-REFERENCE TO RELATED APPLICATIONS

The present application claims priority to and incorporates by reference the entire contents of Japanese Patent Application No. 2013-038961 filed in Japan on Feb. 28, 2013.

BACKGROUND OF THE INVENTION

1. Field of the Invention

The present invention relates to an auto document feeder and an image forming apparatus.

2. Description of the Related Art

Conventionally, apparatuses equipped with various driving systems have disadvantages in that noise, such as drive noise, generated inside the apparatuses may be leaked and disturb the environment.

Furthermore, if openings are formed on main bodies of the apparatuses, a shielding member that opens and closes the openings as needed is generally provided in order to prevent noise generated inside the apparatuses from being leaked from the opening.

However, in sheet conveying apparatuses, such as an auto document feeder (ADF), that sequentially feed and discharge sheets, it is difficult to shield a feed opening and a discharge opening, from which noise inside the apparatuses is leaked, while the apparatuses are running.

This is because, in a configuration in which an outlet is shielded by a discharge shielding member in a normal state and the discharge shielding member is rotated to open the outlet by a conveying force of a sheet being conveyed, it is difficult to cope with thin papers or the like. Furthermore, the stackability is not adequate.

Moreover, it may be possible to shield the outlet by the discharge shielding member in a normal state and open the outlet based on a detection result obtained by a detecting means disposed in a conveying path. However, in this case, a time lag occurs before the shielding member is opened. In this case, it may be possible that the shielding member may not be opened when a sheet reaches the outlet and such a configuration is not practical.

To cope with the above disadvantages, a sheet conveying apparatus has been proposed, in which a shielding member for shielding a feed opening moves according to the number of sheets stacked on a feed tray (see, for example, Japanese Patent Application Laid-open No. 11-334920).

According to the sheet conveying apparatus, the shielding member moves according to the number of sheets stacked on the feed tray, so that the shielding member can move to an appropriate position and shield the feed opening. Therefore, it is possible to prevent leakage of noise from the feed opening.

However, in the sheet conveying apparatus described in Japanese Patent Application Laid-open No. 11-334920, the shielding member moves to a position close to the sheet at the time of sheet feeding. Therefore, a space between the shielding member and the sheet is narrow and the operability of user's operation for, for example, pushing the sheet by his/her finger at the time of sheet feeding is reduced.

Therefore, it is desirable to improve a noise insulation effect by shielding the feed opening and to improve the operability of user's feed operation.

SUMMARY OF THE INVENTION

It is an object of the present invention to at least partially solve the problems in the conventional technology.

According to an aspect of the present invention, there is provided an auto document feeder including: a document stacker on which documents are stacked; a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein at least an end portion of the shielding member on a document stacker side is made of a flexible member.

According to another aspect of the present invention, there is provided an image forming apparatus including an auto document feeder, the auto document feeder including: a document stacker on which documents are stacked; a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein at least an end portion of the shielding member on a document stacker side is made of a flexible member.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

First Embodiment

A first embodiment of the present invention will be explained below with reference to the drawings.

Figure 1:
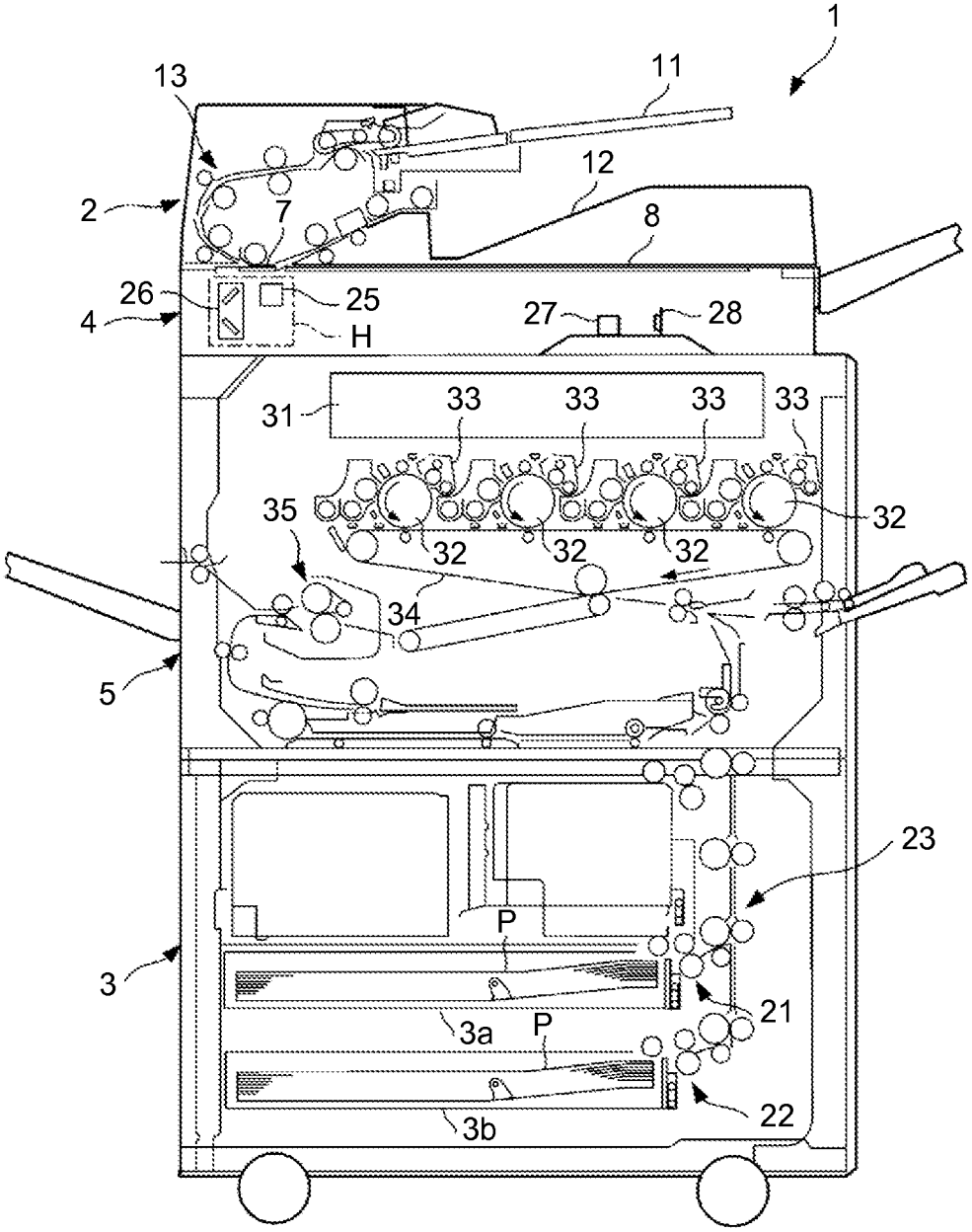
FIG. 1 is an overall configuration diagram of an image forming apparatus according to an embodiment of the present invention.

FIG. 1 is a diagram illustrating an image forming apparatus including an auto document feeder according to an embodiment of the present invention, and in particular, illustrates an example in which a copier 1 of an electrophotographic system is employed as the image forming apparatus. Examples of the copier include a full-color copier that forms images by using a general electrostatic image forming method and a copier that forms monochrome images. Furthermore, as the image forming system, an inkjet system or the like may be employed instead of the electrophotographic system. Moreover, the image forming apparatus including the auto document feeder according to the embodiment may be configured as a facsimile machine, a printer, or a multifunction peripheral (MFP), instead of the copier 1.

As illustrated in FIG. 1, the copier 1 includes an auto document feeder (ADF) 2, a sheet feed unit 3, an image reading unit 4 serving as an image reading means, and an image forming unit 5 serving as an image forming means.

The ADF 2 includes a document table 11 serving as a document stacker and a conveying unit 13 including various rollers, which will be described in detail later. The ADF 2 separates documents stacked on the document table 11 one from another, and conveys each of the documents onto a slit glass 7 by the conveying unit 13. The ADF 2 guides the document that has read by the image reading unit 4 via the slit glass 7 to pass by the slit glass 7 and discharges the document onto a discharge tray 12. The ADF 2 is attached to the image reading unit 4 such that the ADF 2 can be opened and closed via an opening/closing mechanism (not illustrated).

The sheet feed unit 3 includes sheet cassettes 3*a* and 3*b* for storing recording sheets of different sizes, sheet feeders 21 and 22 that pick up and feed recording sheets P that are recording media stored in the sheet cassettes 3*a* and 3*b*, and a conveying unit 23 including various rollers. The various rollers convey the recording sheets P fed from the sheet feeders 21 and 22 to a predetermined image formation position in the image forming unit 5.

The image reading unit 4 includes a first carriage 25 on which a light source and a mirror member are mounted, a second carriage 26 on which a mirror member is mounted, an imaging lens 27, and an imaging unit 28. The image reading unit 4 moves the first carriage 25 and the second carriage 26 to a position denoted by H in FIG. 1, which is just below the slit glass 7, when reading an image of a document conveyed by the ADF 2, and stops the carriages at the position H. Then, the light source mounted on the first carriage 25 emits light toward the document passing by the slit glass 7, and the reflected light from the document is returned by the mirror members mounted on the first carriage 25 and the second carriage 26. Subsequently, the reflected light is collected by the imaging lens 27 and read by the imaging unit 28.

In contrast, when a document placed on a contact glass 8 is to be read, the first carriage 25 and the second carriage 26 are moved to the horizontal direction in FIG. 1 (in the sub-scanning direction). While the first carriage 25 and the second carriage 26 are being moved, the light source emits light toward the document. The reflected light from the document is returned by the mirror members mounted on the first carriage 25 and the second carriage 26, and the reflected light is collected by the imaging lens 27 and read by the imaging unit 28.

The image forming unit 5 includes an exposing device 31, multiple photoconductor drums 32, multiple developing devices 33 each containing toner of a different color of cyan, magenta, yellow, or black, a transfer belt 34, and a fixing device 35. The image forming unit 5 causes the exposing device 31 to expose each of the photoconductor drums 32 based on an image read by the imaging unit 28 to thereby form electrostatic latent images on the photoconductor drums 32, and then causes each of the developing devices 33 to supply toner of a corresponding color to each of the photoconductor drums 32 to thereby develop the images. Subsequently, the image forming unit 5 transfers the images developed on the photoconductor drums 32 onto the recording sheet P fed by the sheet feed unit 3 via the transfer belt 34, causes the fixing device 35 to heat the toner of a toner image transferred on the recording sheet P to thereby fix the color image on the recording sheet P. Therefore, a full-color image is formed on the recording sheet P.

A detailed configuration of the ADF 2 will be explained below with reference to FIG. 2.

Figure 2:
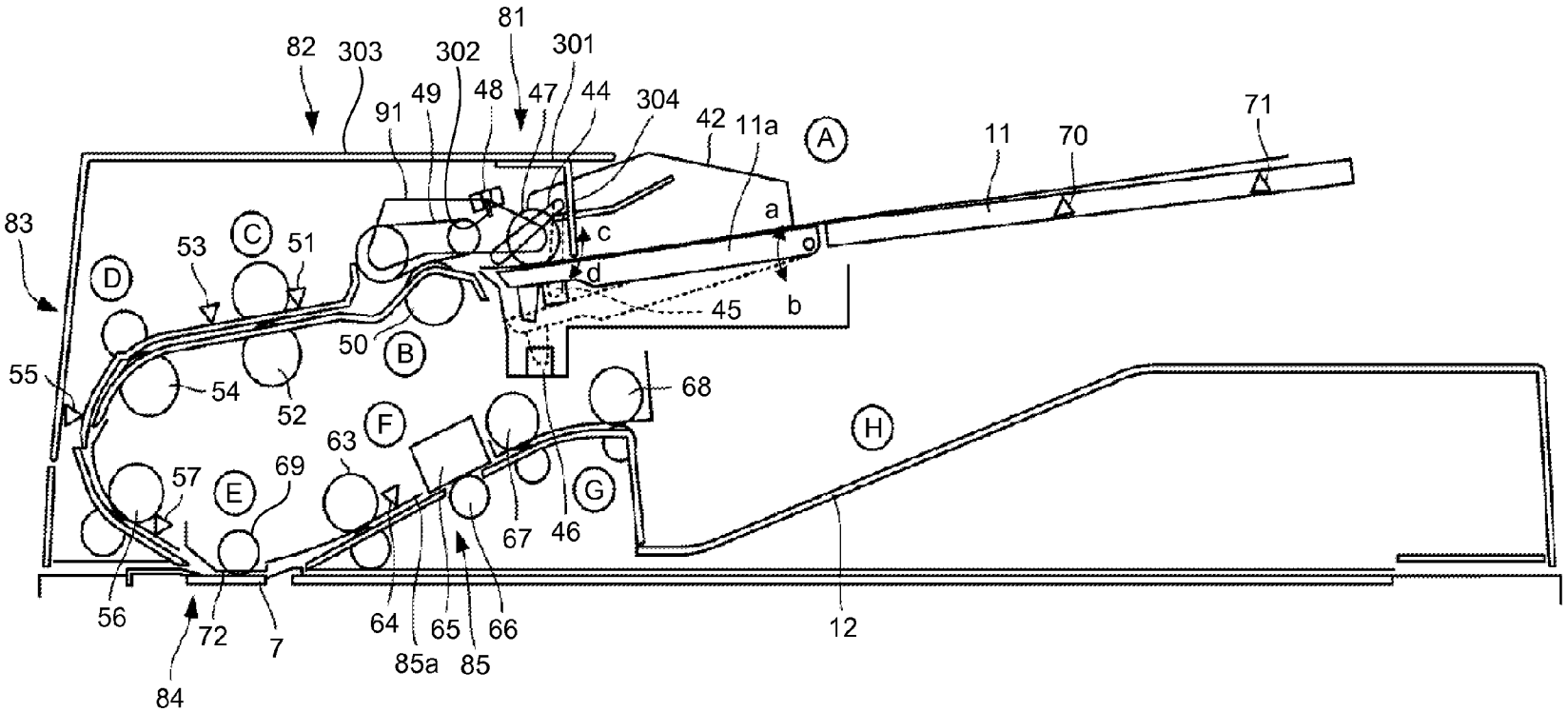
FIG. 2 is an overall configuration diagram of an auto document feeder according to the embodiment of the present invention.

As illustrated in FIG. 2, the document table 11 serving as the document stacker includes a movable document table 11*a* that rotates in directions a and b with a base end used as a fulcrum in the figure, and side guide plates 42 as a pair for determining a horizontal position of a document with respect to a feed direction. Due to the rotation of the movable document table 11*a*, a front end of the document in the feed direction is adjusted to an appropriate height. Incidentally, the "rotation" means rotation in the forward and reverse directions within a predetermined angular range, and the same applies to the explanation below.

A proper feed position sensor 48 is arranged above a front end of the movable document table 11*a*. The proper feed position sensor 48 detects whether the front end of a document stacked on the document stacker in the feed direction is maintained in a proper feed position at an appropriate height.

A home position sensor 46 is arranged below the front end of the movable document table 11*a*. The home position sensor 46 detects whether the movable document table 11*a* is located at a home position.

Furthermore, document-length detection sensors 70 and 71 that detect whether the document is in portrait orientation or landscape orientation are arranged on the document table 11 so as to be spaced apart from each other in the feed direction. Incidentally, the document-length detection sensors 70 and 71 may be reflective sensors that detect documents by optical means in a non-contact manner or contact-type actuator sensors.

The side guide plates 42 as a pair are configured such that one sides thereof can slide in the horizontal direction with respect to the feed direction so that documents of different sizes can be stacked.

A set filler 44 that rotates upon stacking of a document is arranged on a fixed side of the side guide plates 42. Furthermore, a document set sensor 45 that detects that a document is stacked on the document table 11 is arranged in the lowermost part on a moving trajectory of a front end of the set filler 44. Specifically, the document set sensor 45 detects presence or absence of a document set in the ADF 2 based on whether the set filler 44 has rotated and has been deviated from the document set sensor 45.

The conveying unit 13 (see FIG. 1) of the ADF 2 includes a separating/feeding unit 81, a pullout unit 82, a turning unit 83, a first reading/conveying unit 84, a second reading/conveying unit 85, and a discharge unit 86.

The separating/feeding unit 81 includes a pickup roller 47 arranged near a sheet inlet, and includes a feed belt 49 and a reverse roller 50 that are arranged at opposing positions across a conveying path.

The pickup roller 47 is supported by a support arm 91 mounted on the feed belt 49, and is moved up and down via a cam mechanism (not illustrated) in directions c and d in the figure between a contact position at which the pickup roller 47 comes in contact with a stack of documents and a separate position at which the pickup roller 47 separated from the stack of documents. The pickup roller 47 picks up several documents (ideally, a single document) from among the documents stacked on the document table 11 in the contact position.

A feed opening A for introducing a document stacked on the document table 11 into the separating/feeding unit 81 inside the ADF 2 is arranged between the pickup roller 47 and the document table 11. Furthermore, a shielding member 304 that prevents noise from being leaked from the feed opening A is arranged at the feed opening A in order to cope with noise generated inside the ADF 2. The shielding member 304 will be described in detail later.

The feed belt 49 rotates in the feed direction, and the reverse roller 50 rotates in a direction opposite to the feed direction. Furthermore, when multiple documents are fed simultaneously, the reverse roller 50 rotates in the reverse direction with respect to the feed belt 49. However, when the reverse roller 50 is in contact with the feed belt 49 or when only a single document is conveyed, the reverse roller 50 rotates together with the feed belt 49 due to the action of a torque limiter (not illustrated). Therefore, multi-feed of documents can be prevented.

The pullout unit 82 includes pullout rollers 52 as a pair that are arranged so as to sandwich the conveying path. The pullout unit 82 performs primary abutting alignment (so-called skew correction) on the fed document in accordance with drive timings of the pullout rollers 52 and the pickup roller 47, and pulls out and conveys the aligned document.

The turning unit 83 includes intermediate rollers 54 as a pair and read entrance rollers 56 as a pair, which are arranged so as to sandwich the conveying path curved from the upstream side to the downstream side. The turning unit 83 turns the document pulled out and conveyed by the intermediate rollers 54 by conveying the document along the curved conveying path, and causes the read entrance rollers 56 to convey the document with face down to a position close to the slit glass 7.

A document conveying speed from the pullout unit 82 to the turning unit 83 is faster than a conveying speed in the first reading/conveying unit 84. Therefore, a document conveying time to convey the document to the first reading/conveying unit 84 is reduced.

The first reading/conveying unit 84 includes a first read roller 69 arranged opposite to the slit glass 7, and first read exit rollers 63 arranged on a conveying path 85*a* that is used after reading. The first reading/conveying unit 84 conveys the document that has been conveyed to the position close to the slit glass 7 while bringing the front side of the document into contact with the slit glass 7 by the first read roller 69, and then further conveys the read document by the first read exit rollers 63.

The second reading/conveying unit 85 includes a second reading unit 65 that reads the back side of the document, a second read roller 66 arranged opposite to the second reading unit 65 across the conveying path 85*a*, and second read exit rollers 67 arranged on the downstream side of the second reading unit 65 in a document conveying direction. In the second reading/conveying unit 85, the second reading unit 65 reads the back side of the document whose front side has already been read. The document whose back side has been read is conveyed by the second read exit rollers 67 to a sheet outlet. The second read roller 66 prevents the document from floating in the second reading unit 65 and also functions as a reference white unit for acquiring shading data in the second reading unit 65. If double-sided reading is not performed, the document passes through the second reading unit 65 without any operation.

The discharge unit 86 includes discharge rollers 68 as a pair near the sheet outlet, and discharges the document conveyed by the second read exit rollers 67 to the discharge tray 12.

The ADF 2 also includes various sensors, such as an abutting sensor 51, a read entrance sensor 55, a registration sensor 57, and a discharge sensor 64, along the conveying path, and they are used to control a document conveying distance, a document conveying speed, or the like.

Furthermore, a document width sensor 53 is arranged between the pullout rollers 52 and the intermediate rollers 54. The document width sensor 53 includes light-receiving elements arranged in the width direction of the document, and detects the width of the document based on a photodetection result of illumination light applied from the opposing position across the conveying path. The length of the document in the feed direction is detected based on a motor pulse obtained by reading the leading end and the trailing end of the document by the abutting sensor 51.

A control configuration of the ADF 2 will be explained below with reference to FIG. 3.

Figure 3:
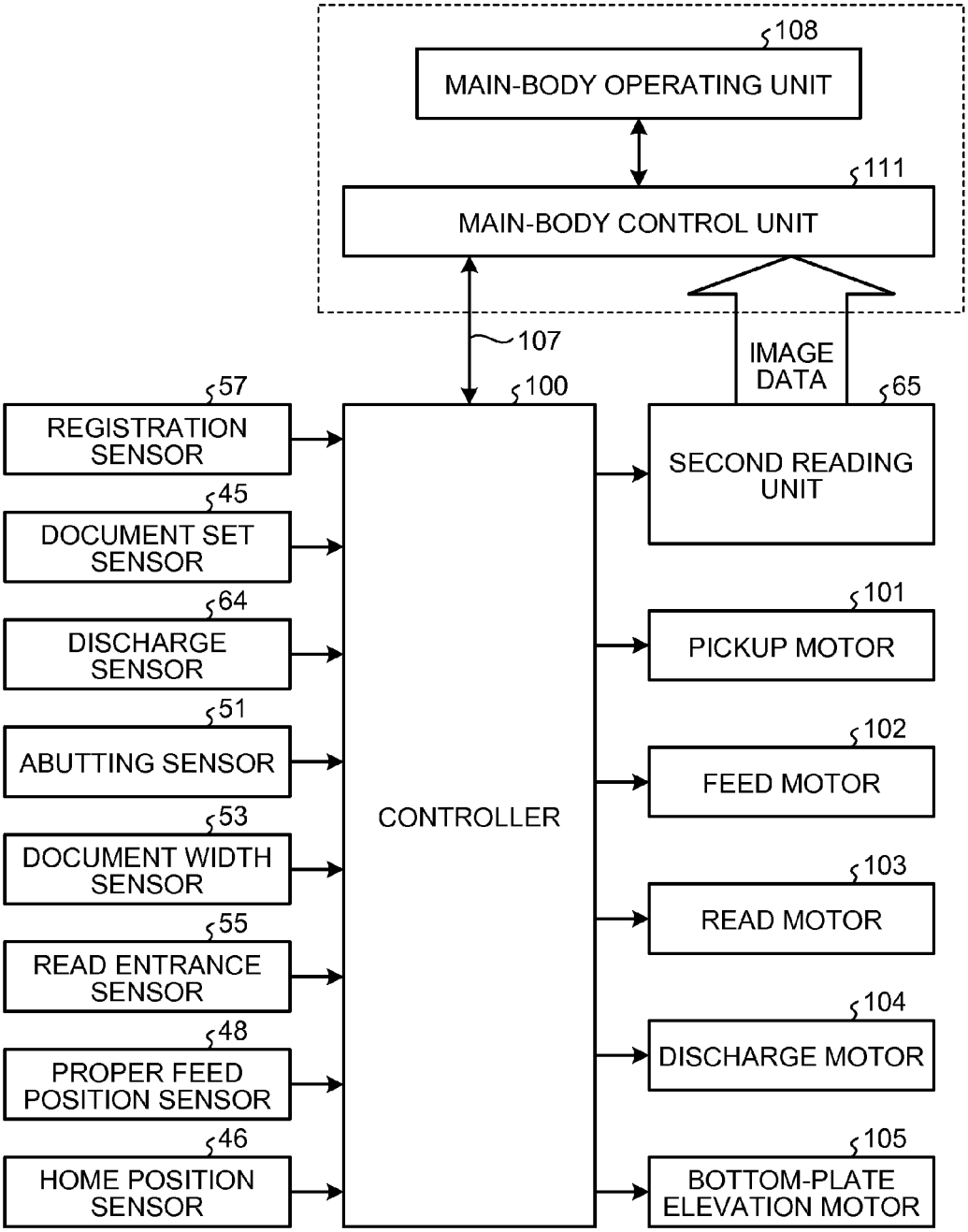
FIG. 3 is a diagram illustrating components for controlling operation according to the embodiment of the present invention.

As illustrated in FIG. 3, the ADF 2 includes a controller 100 that controls the entire ADF 2. The ADF 2 includes sensors as described below to input signals to the controller 100. Specifically, the ADF 2 includes the registration sensor 57, the document set sensor 45, the discharge sensor 64, the abutting sensor 51, the document width sensor 53, the read entrance sensor 55, the proper feed position sensor 48, the home position sensor 46, and the document-length detection sensors 70 and 71. The read entrance sensor 55 is arranged on the upstream side of the turning unit 83 (see FIG. 2), and detects the leading end and the trailing end of the document that enters the turning unit 83. All of the sensors are connected to the controller 100 and transmit signals indicating detection results to the controller 100.

Furthermore, the ADF 2 includes, as motors that drive each of the units of the ADF 2 by outputting signals from the controller 100, a pickup motor 101, a feed motor 102, a read motor 103, a discharge motor 104, and a bottom-plate elevation motor 105. All of the motors are connected to the controller 100.

The bottom-plate elevation motor 105 moves the movable document table 11*a* up and down. The pickup motor 101 moves the pickup roller 47 up and down. The feed motor 102 rotates the pickup roller 47, the feed belt 49, the reverse roller 50, the pullout rollers 52, and the intermediate rollers 54. The read motor 103 rotates the read entrance rollers 56, the first read roller 69, the first read exit rollers 63, and the second read exit rollers 67. The discharge motor 104 rotates the discharge rollers 68.

Each of the motors is controlled by the controller 100 based on the detection signals obtained from the sensors as described above. Furthermore, the second reading unit 65 is connected to the controller 100.

The copier 1 includes a main-body control unit 111 that controls the entire apparatus, and includes a main-body operating unit 108 that performs various input operations and gives instructions on operations. The controller 100 and the main-body control unit 111 are connected to each other via an interface (I/F) 107 so as to transmit and receive data, such as control signals, to and from each other. In the main-body operating unit 108, a user can select a double-sided mode or a single-sided mode as a read mode for reading a document by the ADF 2. The user may set the same read mode for all of documents stacked on the document table 11 or set a different read mode for each of the documents. For example, it may be possible to set the double-sided mode for the first and the tenth documents in a stack of ten documents and set the single-sided mode for the rest of the documents.

In the ADF 2 configured as above, when the read entrance sensor 55 detects the leading end of the document conveyed by the first reading/conveying unit 84, the document conveying speed is decelerated to the same speed as a read conveying speed before the leading end of the document enters a nip between the read entrance rollers 56. At the same time, the read motor 103 is rotated clockwise (CW), so that the read entrance rollers 56, the first read roller 69, the first read exit rollers 63, and the second read exit rollers 67 are rotated.

When the registration sensor 57 detects the leading end of the document, the conveying speed of the document is decelerated over a predetermined distance and the document is temporarily stopped in front of a read position 7*a*. At this time, the controller 100 transmits a registration stop signal to the main-body control unit 111 via the I/F 107. Subsequently, when the main-body control unit 111 receives a read start signal, the conveying speed of the document stopped for the registration is accelerated to a predetermined conveying speed before the leading end of the document reaches the read position 7*a* and the document is conveyed. At a timing at which the leading end of the document detected based on a pulse count of the read motor 103 reaches the first reading/conveying unit 84, a gate signal indicating a valid image area of the first surface (front side) in the sub-scanning direction is transmitted to the main-body control unit 111 until the trailing end of the document passes through the first reading/conveying unit 84.

When the read mode is the single-sided mode, the document that has passed through the first reading/conveying unit 84 is conveyed to the discharge unit 86 via the second reading unit 65. In this case, when the discharge sensor 64 detects the leading end of the document, the discharge motor 104 is rotated clockwise (CW) to thereby rotate the discharge rollers 68 counterclockwise. Furthermore, at this time, a driving speed of the discharge motor 104 is decelerated just before the trailing end of the document passes through the nip between the upper and lower discharge rollers 68 as a pair, based on a discharge motor pulse count obtained since the detection of the leading end of the document by the discharge sensor 64. Accordingly, the document is controlled so that the document to be discharged on the discharge tray 12 does not fall out.

When the read mode is the double-sided mode, the discharge sensor 64 first detects the leading end of the document. Subsequently, a gate signal indicating a valid image area in the sub-scanning direction is transmitted from the controller 100 to the second reading unit 65 at a timing at which the leading end of the document reaches the second reading unit 65 based on a pulse count obtained by the read motor 103, until the trailing end of the document passes through the second reading unit 65.

A control configuration of the second reading unit 65 will be explained below with reference to FIG. 4.

Figure 4:
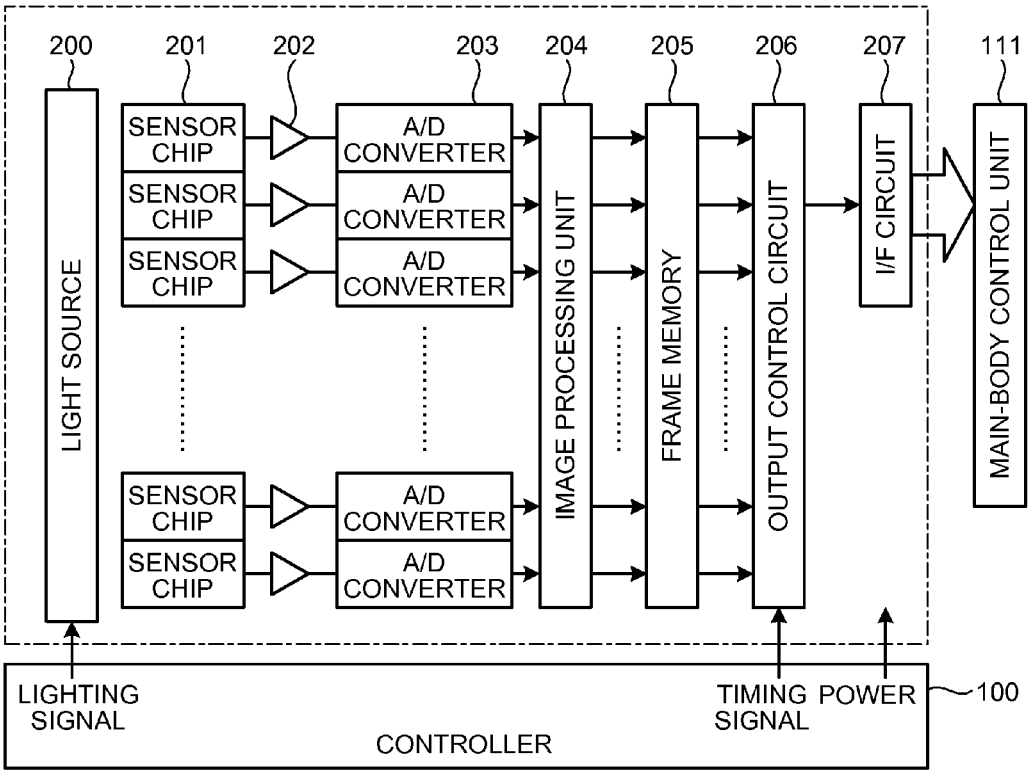
FIG. 4 is a diagram illustrating a signal path between the auto document feeder and the image forming apparatus according to the embodiment of the present invention.

As illustrated in FIG. 4, the second reading unit 65 includes a light source 200, sensor chips 201, amplifiers 202, analog-to-digital (A/D) converters 203, an image processing unit 204, and a frame memory 205.

The second reading unit 65 causes the light source 200 to emit light to the document based on a lighting signal received from the controller 100, and causes each of the sensor chips 201 to receive reflected light from the document, convert the reflected light to electrical signals, and output the electrical signals. The second reading unit 65 causes the amplifiers 202 to amplify the electrical signals output by the sensor chips 201, causes the A/D converters 203 to convert the analog signals to digital signals, and causes the image processing unit 204 to perform image processing. The signals subjected to the image processing are stored in the frame memory 205.

The second reading unit 65 also includes an output control circuit 206 that controls output of signals stored in the frame memory based on timing signals received from the controller 100, and includes an I/F circuit 207. The I/F circuit 207 outputs signals received from the output control circuit 206 to the main-body control unit 111.

The shielding member 304 of the ADF 2 will be explained in detail below with reference to FIG. 5 to FIG. 14.

As illustrated in FIG. 2, the shielding member 304 is arranged on the upstream side of the pickup roller 47 so as to be located above the topmost document placed on the movable document table 11*a* and so as to cover the entire area in the vertically downward direction with respect to an upper cover member 303. The upper cover member 303 is a member that covers the top surface of the main body of the ADF 2. By shielding the feed opening A by the shielding member 304, it becomes possible to prevent leakage of noise generated inside the ADF 2.

The shielding member 304 includes a shielding main body 304*a* and a front end 304*b* of the shielding member. The shielding main body 304*a* is a portion of the shielding member 304 other than an end portion on the document stacker. The shielding main body 304*a* has an inverted L-shape in a side view, and is fixedly mounted on the inner side of the upper cover member 303. The side view is viewed in a depth direction from the front side of the ADF 2 in FIG. 2. Therefore, as will be described later, the shielding member 304 can move up and down in conjunction with opening and closing of the upper cover member 303. The front end 304*b* of the shielding member is an end portion of the shielding member 304 on the document stacker side.

Figure 12:
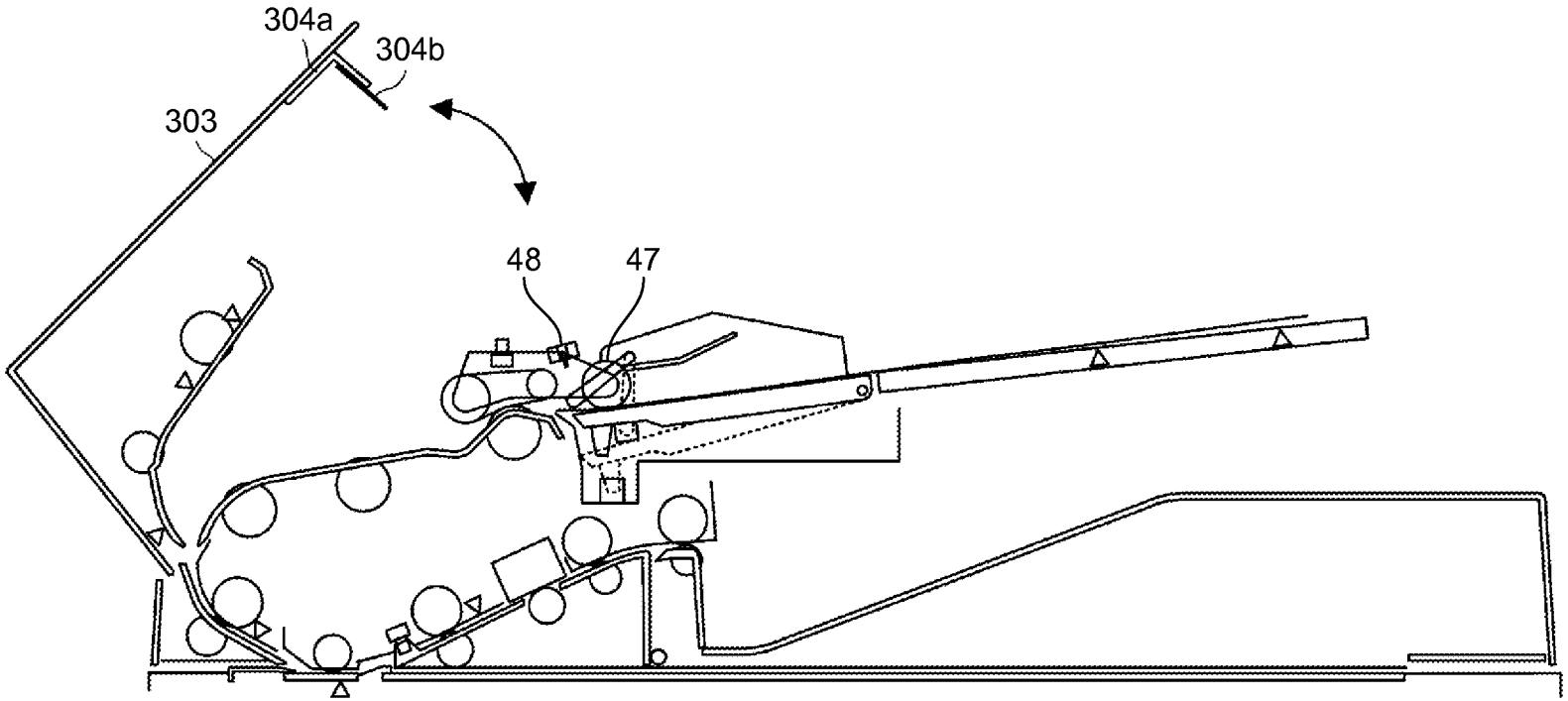
FIG. 12 is a diagram illustrating operation for opening and closing the upper cover member on the top surface of the main body of the auto document feeder, in the auto document feeder according to the embodiment of the present invention.

As illustrated in FIG. 12, the upper cover member 303 is supported by the main body of the ADF 2 such that the upper cover member 303 can be opened and closed about a rotation fulcrum (not illustrated) on the downstream side in the document conveying direction. Therefore, when the upper cover member 303 is opened, the shielding member 304 moves in a direction in which the feed opening A is opened, so that a feed path is exposed in the ADF 2. Therefore, for example, when a service person removes a document in the case of document jam or cleans components, such as the conveying unit 23 or the sensors, he/she can put aside the shielding member 304, so that operation may not be disturbed.

The front end 304*b* of the shielding member is mounted on an end portion of the shielding main body 304*a* on the movable document table 11*a* side. The front end 304*b* of the shielding member is made of a flexible member, such as a rubber sheet, with high density and low rigidity.

Figure 7:
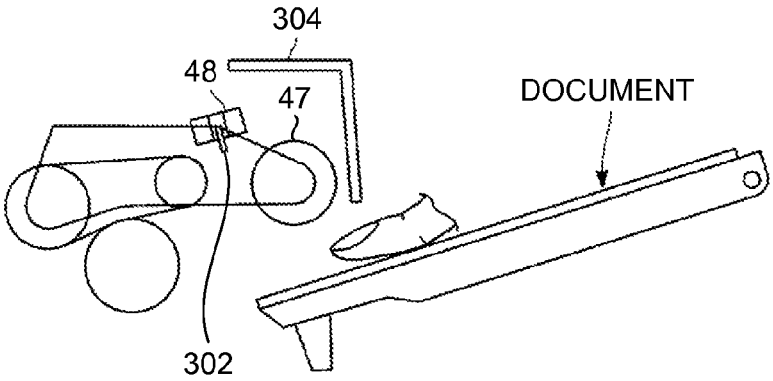
FIG. 7 is a diagram illustrating a state of user's operation for setting a document in the auto document feeder according to the embodiment of the present invention.
Figure 8:
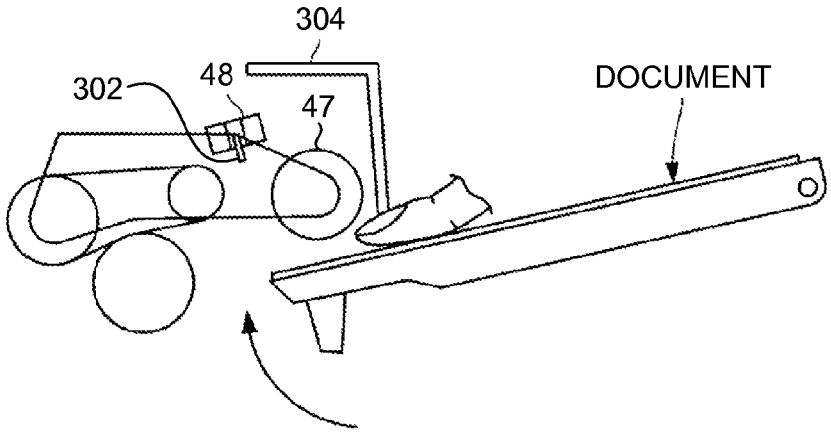
FIG. 8 is a diagram illustrating a state of user's operation when a document stacker is lifted up in the auto document feeder according to the embodiment of the present invention.

FIGS. 7 and 8 illustrate examples in which the front end 304*b* of the shielding member is not made of a flexible member. In this case, if the finger of a user touches the front end 304*b* of the shielding member, the front end 304*b* is not elastically deformed, so that the operability of user's feed operation is reduced.

Figure 10:
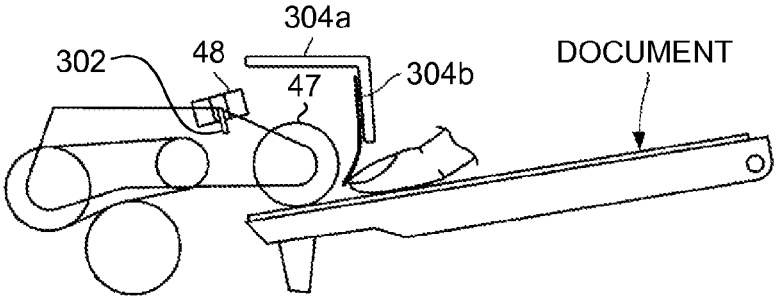
FIG. 10 is a diagram illustrating a state of user's operation when the document stacker is lifted up in the auto document feeder according to the embodiment of the present invention.

In contrast, if the front end 304*b* of the shielding member is made of a flexible member, as illustrated in FIG. 10, when the finger of the user touches the front end 304*b* of the shielding member for example, the front end 304*b* is elastically deformed, so that the operability of the user's feed operation can be improved.

A method for setting the position of the front end of the shielding member 304 will be explained below.

Auto document feeders scan a large number of documents at one time; therefore, in some auto document feeders, the movable document table 11*a* is configured to move up and down as illustrated in FIG. 2. In this case, the feed position of the topmost document is determined as described below. First, the topmost document lifts the pickup roller 47 up with elevation of the movable document table 11*a*, so that a filler 302 arranged on a bracket that rotatably supports the pickup roller 47 is lifted up. Subsequently, the proper feed position sensor 48 is shielded from light, so that the position is determined. Therefore, the position of the pickup roller 47 at the time of sheet feeding is always constant regardless of the number of documents.

Figure 5:
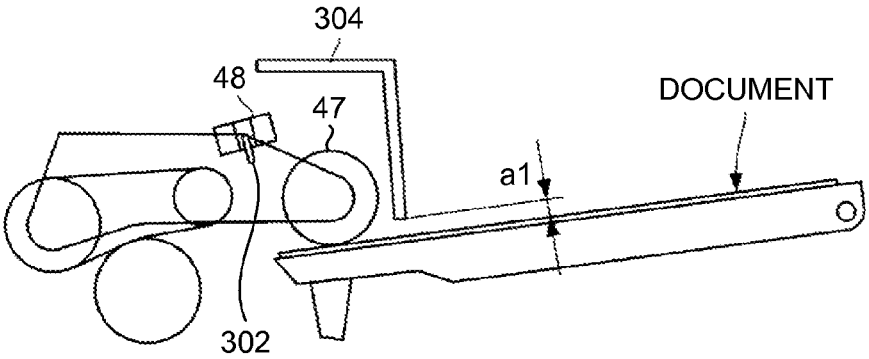
FIG. 5 is a diagram illustrating a positional relationship between a leading end of the shielding member and a document when one sheet of document is set in the auto document feeder according to the embodiment of the present invention.
Figure 6:
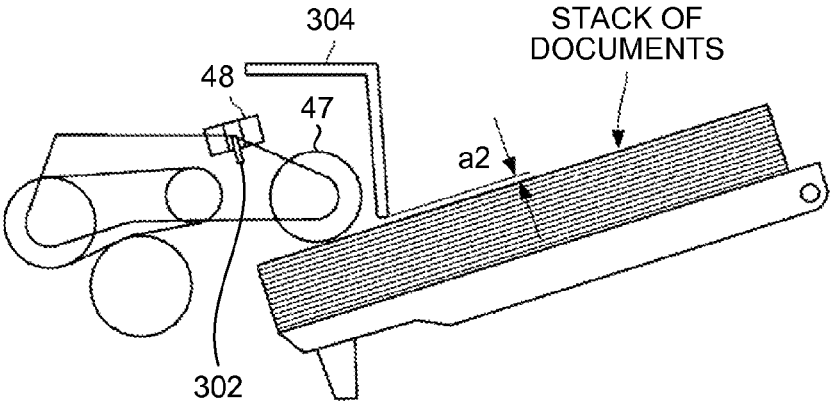
FIG. 6 is a diagram illustrating a positional relationship between the leading end of the shielding member and documents when a large number of documents are set in the auto document feeder according to the embodiment of the present invention.

However, when the movable document table 11*a* is rotatable as illustrated in FIG. 2, and if a large number of documents are placed as illustrated in FIGS. 5 and 6, an angle with respect to the documents at the time of sheet feeding increases, so that a gap between the topmost document and the front end 304*b* of the shielding member is represented by $a2<a1$. Therefore, the position of the front end 304*b* of the shielding member in the height direction needs to be set at a height at which the front end 304*b* does not come into contact with the topmost document when the upper limit number of documents are stacked on the auto document feeder. However, because a noise insulation effect is reduced as the gap increases, it is desirable to set the position as close to the topmost document as possible.

As described above, the image forming apparatus according to the first embodiment includes the shielding member 304 that shields the feed opening A. Therefore, it is possible to prevent leakage of noise generated inside the ADF 2.

Furthermore, the front end 304*b* of the shielding member is made of a flexible member, such as a rubber sheet, with high density and low rigidity. Therefore, for example, when the finger of a user touches the front end 304*b* of the shielding member, the front end 304*b* is elastically deformed, so that the operability of user's feed operation can be improved.

Figure 11:
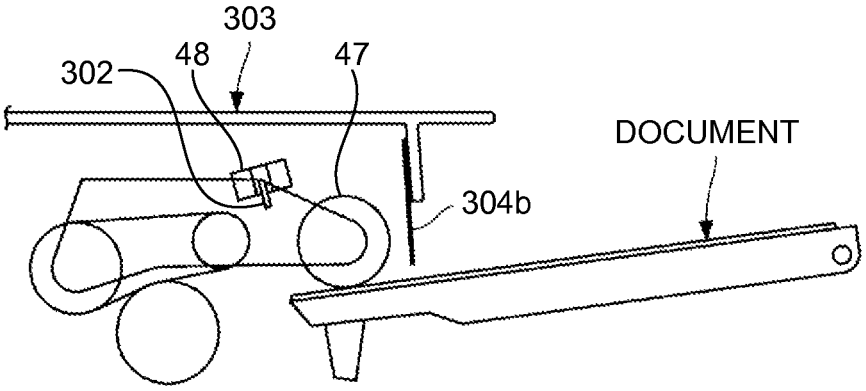
FIG. 11 is a diagram illustrating a state in which portions other than an end portion of the shielding member on the document stacker side and an upper cover member on the top surface of a main body of the auto document feeder are integrally formed according to the embodiment of the present invention.

In the first embodiment, it is explained that a separate component is fixedly mounted on the upper cover member 303. However, as illustrated in FIG. 11 for example, it may be possible to integrate portions other than the front end 304*b* of the shielding member with the upper cover member 303 that covers the upper part of the apparatus in FIG. 1. With this configuration, it becomes possible to reduce the number of components.

Furthermore, in the first embodiment, the shielding member 304 is formed of two separate components such as the shielding main body 304*a* and the front end 304*b* of the shielding member. However, for example, it may be possible to form the shielding member 304 as a single component by integrally forming the shielding main body 304*a* and the front end 304*b* of the shielding member and molding the shielding member 304 having the integrated shielding main body 304*a* and the front end 304*b* with soft elastomer resin. With this configuration, it becomes possible to reduce the number of components.

Second Embodiment

A second embodiment of the present invention will be explained below with reference to FIGS. 13 and 14.

The second embodiment is different from the first embodiment in that a cover 305 is mounted to prevent a contact between the shielding member 304 and the pickup roller 47. Other configurations of the second embodiment are the same as the first embodiment. Therefore, only a difference from the first embodiment will be explained below.

Figure 9:
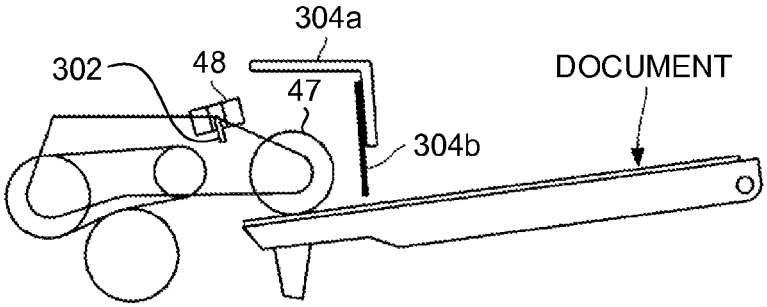
FIG. 9 is a diagram illustrating a state in which a document is conveyed from the document stacker in the auto document feeder according to the embodiment of the present invention.

In the first embodiment, as illustrated in FIG. 9, the front end 304*b* of the shielding member is made of a flexible member to prevent a jam between the shielding member 304 and a document. However, in this configuration, if the flexible member is pushed in the feed direction during feed operation, the front end 304*b* of the shielding member may come in contact with the pickup roller 47 being rotated. If such a contact occurs, the flexible member may be damaged or may be caught resulting in a jam.

Figure 13:
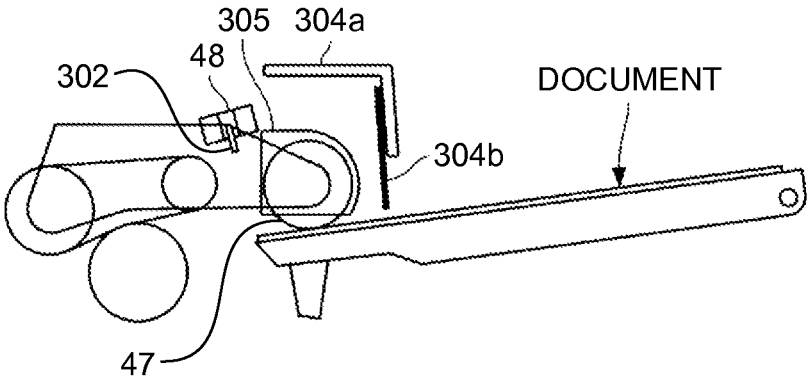
FIG. 13 is a diagram illustrating a state in which a document is conveyed from the document stacker in the auto document feeder according to the embodiment of the present invention.
Figure 14:
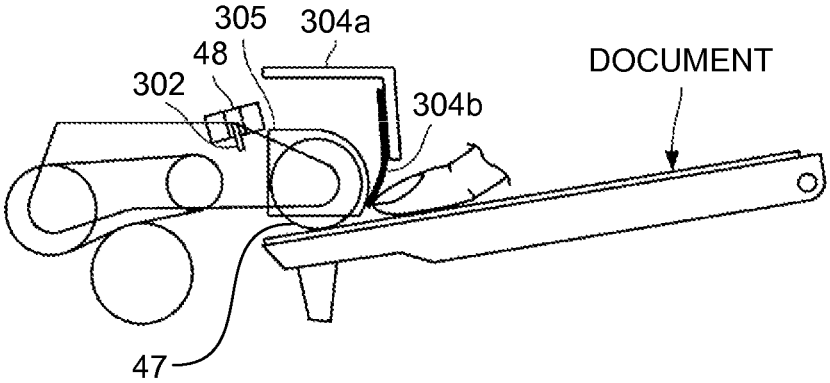
FIG. 14 is a diagram illustrating a state of user's operation when the document stacker is lifted up in the auto document feeder according to the embodiment of the present invention.

Therefore, in the second embodiment, as illustrated in FIGS. 13 and 14, the cover 305 is mounted between the pickup roller 47 and the shielding member 304 to cover the top and front sides of the pickup roller 47. The front side means a side where the pickup roller 47 faces the shielding member 304.

The cover 305 has an approximately quarter circle with an arc on the upper right side in a side view, and is mounted on the support arm 91.

With this configuration, it is possible to prevent a contact between the front end 304*b* of the shielding member, which is made of a flexible member, and the pickup roller 47.

As described above, the image forming apparatus according to the second embodiment includes the cover 305 between the pickup roller 47 and the shielding member 304 so as to cover the top and front sides of the pickup roller 47. Therefore, it becomes possible to prevent a contact between the front end 304*b* of the shielding member, which is made of a flexible member, and the pickup roller 47. Therefore, it becomes possible to prevent the flexible member from being damaged or being caught, enabling to prevent a jam.

According to the embodiments, it is possible to shield the feed opening by the shielding member to improve the noise insulation effect and improve the operability of user's feed operation.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An auto document feeder comprising:

a document stacker on which documents are stacked;

a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein:

the shielding member includes a shielding main body and a front end, which is separate from the shielding main body, the front end, made of a flexible member, is attached to an end portion of the shielding main body on a document stacker side, portions of the shielding member other than the front end portion are integrated with an upper cover arranged on a top surface of a main body of the auto document feeder, and the upper cover is opened and closed relative to the main body of the auto document feeder to expose a feed path.

2. The auto document feeder according to claim 1, wherein portions of the shielding member other than the front end portion are integrated with an upper cover arranged on a top surface of a main body of the auto document feeder.

3. The auto document feeder according to claim 2, wherein the shielding member is fixed to the upper cover.

4. The auto document feeder according to claim 1, wherein the end portion of the shielding member on the document stacker side is made of a rubber sheet.

5. An auto document feeder comprising:

a document stacker on which documents are stacked;

a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein:

the shielding member includes a shielding main body and a front end, which is separate from the shielding main body, the front end, made of a flexible member, is attached to an end portion of the shielding main body on a document stacker side, portions of the shielding member other than the front end portion are integrated with an upper cover arranged on a top surface of a main body of the auto document feeder, the shielding member is fixed to the upper cover, and the upper cover is opened and closed relative to the main body of the auto document feeder to expose a feed path.

6. An auto document feeder comprising:

a document stacker on which documents are stacked;

a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein:

the shielding member includes a shielding main body and a front end, which is separate from the shielding main body, the front end, made of a flexible member, is attached to an end portion of the shielding main body on a document stacker side, and the shielding main body has an inverted L-shape in a side view.

7. An auto document feeder comprising:

a document stacker on which documents are stacked;

a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein:

the shielding member includes a shielding main body and a front end, which is separate from the shielding main body, the front end, made of a flexible member, is attached to an end portion of the shielding main body on a document stacker side, and the shielding main body is fixedly mounted on an inner side of an upper cover member.

8. The auto document feeder according to claim 7, wherein the shielding member moves up and down in conjunction with opening and closing of an upper cover member.

9. The auto document feeder according to claim 7, wherein the upper cover member is supported by a main body of the auto document feeder.

10. The auto document feeder according to claim 9, wherein the upper cover member opens and closes about a rotation fulcrum on a downstream side in the document conveying direction.

11. The auto document feeder according to claim 7, wherein when the upper cover member is opened, the shielding member moves in a direction in which the feed opening is opened, so that a feed path is exposed in the auto document feeder.

12. An image forming apparatus comprising an auto document feeder, the auto document feeder comprising:

a document stacker on which documents are stacked;

a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein:

the shielding member includes a shielding main body and a front end, which is separate from the shielding main body, the front end, made of a flexible member, is attached to an end portion of the shielding main body on a document stacker side, portions of the shielding member other than the front end portion are integrated with an upper cover arranged on a top surface of a main body of the auto document feeder, and the upper cover is opened and closed relative to the main body of the auto document feeder to expose a feed path.

13. An image forming apparatus comprising an auto document feeder, the auto document feeder comprising:

a document stacker on which documents are stacked;

a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein:

the shielding member includes a shielding main body and a front end, which is separate from the shielding main body, the front end, made of a flexible member, is attached to an end portion of the shielding main body on a document stacker side, portions of the shielding member other than the front end portion are integrated with an upper cover arranged on a top surface of a main body of the auto document feeder, the shielding member is fixed to the upper cover, and the upper cover is opened and closed relative to the main body of the auto document feeder to expose a feed path.

14. An image forming apparatus comprising an auto document feeder, the auto document feeder comprising:

a document stacker on which documents are stacked;

a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein:

the shielding member includes a shielding main body and a front end, which is separate from the shielding main body, the front end, made of a flexible member, is attached to an end portion of the shielding main body on a document stacker side, and the shielding main body has an inverted L-shape in a side view.

15. An image forming apparatus comprising an auto document feeder, the auto document feeder comprising:

a document stacker on which documents are stacked;

a pickup roller that feeds a topmost document among the documents on the document stacker to a feed position via a feed opening; and a shielding member that is arranged on an upstream side of the pickup roller in a document conveying direction and above the topmost document, and that shields the feed opening, wherein:

the shielding member includes a shielding main body and a front end, which is separate from the shielding main body, the front end, made of a flexible member, is attached to an end portion of the shielding main body on a document stacker side, and the shielding main body is fixedly mounted on an inner side of an upper cover member.

* * * * *